US008424610B2

(12) United States Patent
Newton et al.

(10) Patent No.: US 8,424,610 B2
(45) Date of Patent: Apr. 23, 2013

(54) FLOW CONTROL ARRANGEMENT AND METHOD

(75) Inventors: Daniel Newton, Jakarta (ID); Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 278 days.

(21) Appl. No.: 12/718,510

(22) Filed: Mar. 5, 2010

(65) Prior Publication Data

US 2011/0214881 A1 Sep. 8, 2011

(51) Int. Cl.
*E21B 29/02* (2006.01)

(52) U.S. Cl.
USPC ..... 166/376; 166/317

(58) Field of Classification Search ..... 166/317, 166/376; 137/68.11, 467.5, 2; 251/369
See application file for complete search history.

(56) References Cited

U.S. PATENT DOCUMENTS

| | | | | |
|---|---|---|---|---|
| 2,238,895 | A | | 4/1941 | Gage |
| 2,261,292 | A | | 11/1941 | Salnikov |
| 3,106,959 | A | | 10/1963 | Huitt et al. |
| 3,326,291 | A | * | 6/1967 | Zandmer ..... 166/100 |
| 3,412,797 | A | * | 11/1968 | Huitt et al. ..... 166/308.1 |
| 3,465,181 | A | | 9/1969 | Colby et al. |
| 3,513,230 | A | | 5/1970 | Rhees et al. |
| 3,637,446 | A | | 1/1972 | Elliott et al. |
| 3,645,331 | A | | 2/1972 | Maurer et al. |
| 3,775,823 | A | | 12/1973 | Adolph et al. |
| 3,894,850 | A | | 7/1975 | Kovalchuk et al. |
| 4,010,583 | A | | 3/1977 | Highberg |
| 4,039,717 | A | | 8/1977 | Titus |
| 4,248,307 | A | | 2/1981 | Silberman et al. |
| 4,372,384 | A | | 2/1983 | Kinney |
| 4,373,584 | A | | 2/1983 | Silberman et al. |
| 4,374,543 | A | | 2/1983 | Richardson |

(Continued)

FOREIGN PATENT DOCUMENTS

| | | |
|---|---|---|
| EP | 1798301 A1 | 8/2006 |
| JP | 2000185725 | 7/2000 |

(Continued)

OTHER PUBLICATIONS

Flow Control Systems, [online]; [retrieved on May 20, 2010]; retrieved from the Internet http://www.bakerhughes.com/products-and-services/completions-and-productions/well-completions/packers-and-flow-control/flow-control-systems.

(Continued)

*Primary Examiner* — Brad Harcourt
*Assistant Examiner* — Blake Michener
(74) *Attorney, Agent, or Firm* — Cantor Colburn LLP

(57) ABSTRACT

A flow control arrangement includes a housing defining one or more openings therein. A valve structure is alignable and misalignable with the one or more openings in the housing. Further included in the flow control arrangement is one or more plugs, one each in each of the one or more openings. Each plug is reducible by one or more of exposure to downhole fluids and applied dissolution fluids. A method for carrying out a series of downhole operations includes running the flow control arrangement to a target depth, carrying out a downhole operation requiring the housing to be radially permeability fluid restricted, reducing the plug, carrying out a downhole operation requiring fluid pressure communication through the one or more openings, and mechanically intervening to close the valve structure thereby rendering the one or more openings of the arrangement radially impermeable.

10 Claims, 5 Drawing Sheets

U.S. PATENT DOCUMENTS

| | | | | |
|---|---|---|---|---|
| 4,384,616 | A | | 5/1983 | Dellinger |
| 4,399,871 | A | | 8/1983 | Adkins et al. |
| 4,422,508 | A | | 12/1983 | Rutledge, Jr. et al. |
| 4,452,311 | A | | 6/1984 | Speegle et al. |
| 4,498,543 | A | | 2/1985 | Pye et al. |
| 4,534,414 | A | | 8/1985 | Pringle |
| 4,640,354 | A | | 2/1987 | Boisson |
| 4,664,962 | A | | 5/1987 | DesMarais, Jr. |
| 4,674,572 | A | | 6/1987 | Gallus |
| 4,678,037 | A | | 7/1987 | Smith |
| 4,681,133 | A | | 7/1987 | Weston |
| 4,688,641 | A | | 8/1987 | Knieriemen |
| 4,693,863 | A | | 9/1987 | Del Corso et al. |
| 4,703,807 | A | | 11/1987 | Weston |
| 4,706,753 | A | | 11/1987 | Ohkochi et al. |
| 4,708,202 | A | | 11/1987 | Sukup et al. |
| 4,708,208 | A | | 11/1987 | Halbardier |
| 4,709,761 | A | | 12/1987 | Setterberg, Jr. |
| 4,714,116 | A | | 12/1987 | Brunner |
| 4,716,964 | A | | 1/1988 | Erbstoesser et al. |
| 4,721,159 | A | | 1/1988 | Ohkochi et al. |
| 4,738,599 | A | | 4/1988 | Shilling |
| 4,741,973 | A | | 5/1988 | Condit et al. |
| 4,768,588 | A | | 9/1988 | Kupsa |
| 4,784,226 | A | | 11/1988 | Wyatt |
| 4,805,699 | A | | 2/1989 | Halbardier |
| 4,817,725 | A | | 4/1989 | Jenkins |
| 4,834,184 | A | | 5/1989 | Streich et al. |
| H635 | H | | 6/1989 | Johnson et al. |
| 4,850,432 | A | | 7/1989 | Porter et al. |
| 4,853,056 | A | | 8/1989 | Hoffman |
| 4,869,324 | A | | 9/1989 | Holder |
| 4,869,325 | A | | 9/1989 | Halbardier |
| 4,889,187 | A | | 12/1989 | Terrell et al. |
| 4,890,675 | A | | 1/1990 | Dew |
| 4,909,320 | A | | 3/1990 | Hebert et al. |
| 4,932,474 | A | | 6/1990 | Schroeder, Jr. et al. |
| 4,944,351 | A | | 7/1990 | Eriksen et al. |
| 4,949,788 | A | | 8/1990 | Szarka et al. |
| 4,952,902 | A | | 8/1990 | Kawaguchi et al. |
| 4,977,958 | A | | 12/1990 | Miller |
| 4,981,177 | A | | 1/1991 | Carmody et al. |
| 4,986,361 | A | | 1/1991 | Mueller et al. |
| 5,006,044 | A | | 4/1991 | Walker, Sr. et al. |
| 5,010,955 | A | | 4/1991 | Springer |
| 5,036,921 | A | | 8/1991 | Pittard et al. |
| 5,048,611 | A | | 9/1991 | Cochran |
| 5,049,165 | A | | 9/1991 | Tselesin |
| 5,063,775 | A | | 11/1991 | Walker, Sr. et al. |
| 5,074,361 | A | | 12/1991 | Brisco et al. |
| 5,090,480 | A | | 2/1992 | Pittard et al. |
| 5,095,988 | A | | 3/1992 | Bode |
| 5,103,911 | A | | 4/1992 | Heijnen |
| 5,117,915 | A | | 6/1992 | Mueller et al. |
| 5,161,614 | A | | 11/1992 | Wu et al. |
| 5,178,216 | A | | 1/1993 | Giroux et al. |
| 5,181,571 | A | | 1/1993 | Mueller et al. |
| 5,188,182 | A | | 2/1993 | Echols, III et al. |
| 5,188,183 | A | | 2/1993 | Hopmann et al. |
| 5,222,867 | A | | 6/1993 | Walker, Sr. et al. |
| 5,226,483 | A | | 7/1993 | Williamson, Jr. |
| 5,228,518 | A | | 7/1993 | Wilson et al. |
| 5,234,055 | A | | 8/1993 | Cornette |
| 5,253,714 | A | | 10/1993 | Davis et al. |
| 5,271,468 | A | | 12/1993 | Streich et al. |
| 5,282,509 | A | | 2/1994 | Schurr, III |
| 5,292,478 | A | | 3/1994 | Scorey |
| 5,293,940 | A | | 3/1994 | Hromas et al. |
| 5,309,874 | A | | 5/1994 | Willermet et al. |
| 5,310,000 | A | | 5/1994 | Arterbury et al. |
| 5,392,860 | A | | 2/1995 | Ross |
| 5,394,941 | A | | 3/1995 | Venditto et al. |
| 5,398,754 | A | | 3/1995 | Dinhoble |
| 5,407,011 | A | | 4/1995 | Layton |
| 5,411,082 | A | | 5/1995 | Kennedy |
| 5,417,285 | A | | 5/1995 | Van Buskirk et al. |
| 5,425,424 | A | * | 6/1995 | Reinhardt et al. ..... 166/291 |
| 5,427,177 | A | | 6/1995 | Jordan, Jr. et al. |
| 5,435,392 | A | | 7/1995 | Kennedy |
| 5,439,051 | A | | 8/1995 | Kennedy et al. |
| 5,454,430 | A | | 10/1995 | Kennedy et al. |
| 5,456,317 | A | | 10/1995 | Hood, III et al. |
| 5,464,062 | A | | 11/1995 | Blizzard, Jr. |
| 5,472,048 | A | | 12/1995 | Kennedy et al. |
| 5,474,131 | A | | 12/1995 | Jordan, Jr. et al. |
| 5,477,923 | A | | 12/1995 | Jordan, Jr. et al. |
| 5,479,986 | A | | 1/1996 | Gano et al. |
| 5,526,880 | A | | 6/1996 | Jordan, Jr. et al. |
| 5,526,881 | A | | 6/1996 | Martin et al. |
| 5,533,573 | A | | 7/1996 | Jordan, Jr. et al. |
| 5,536,485 | A | | 7/1996 | Kume et al. |
| 5,558,153 | A | | 9/1996 | Holcombe et al. |
| 5,607,017 | A | | 3/1997 | Owens et al. |
| 5,623,993 | A | | 4/1997 | Van Buskirk et al. |
| 5,623,994 | A | | 4/1997 | Robinson |
| 5,636,691 | A | | 6/1997 | Hendrickson et al. |
| 5,641,023 | A | | 6/1997 | Ross et al. |
| 5,647,444 | A | | 7/1997 | Williams |
| 5,677,372 | A | | 10/1997 | Yamamoto et al. |
| 5,707,214 | A | | 1/1998 | Schmidt |
| 5,709,269 | A | | 1/1998 | Head |
| 5,720,344 | A | | 2/1998 | Newman |
| 5,765,639 | A | | 6/1998 | Muth |
| 5,772,735 | A | | 6/1998 | Sehgal et al. |
| 5,782,305 | A | | 7/1998 | Hicks |
| 5,797,454 | A | | 8/1998 | Hipp |
| 5,826,652 | A | | 10/1998 | Tapp |
| 5,826,661 | A | | 10/1998 | Parker et al. |
| 5,829,520 | A | * | 11/1998 | Johnson ..... 166/250.01 |
| 5,836,396 | A | | 11/1998 | Norman |
| 5,857,521 | A | | 1/1999 | Ross et al. |
| 5,881,816 | A | | 3/1999 | Wright |
| 5,934,372 | A | | 8/1999 | Muth |
| 5,941,309 | A | | 8/1999 | Appleton |
| 5,960,881 | A | | 10/1999 | Allamon et al. |
| 5,985,466 | A | | 11/1999 | Atarashi et al. |
| 5,990,051 | A | | 11/1999 | Ischy et al. |
| 5,992,452 | A | | 11/1999 | Nelson, II |
| 5,992,520 | A | | 11/1999 | Schultz et al. |
| 6,007,314 | A | | 12/1999 | Nelson, II |
| 6,024,915 | A | | 2/2000 | Kume et al. |
| 6,047,773 | A | | 4/2000 | Zeltmann et al. |
| 6,050,340 | A | | 4/2000 | Scott |
| 6,069,313 | A | | 5/2000 | Kay |
| 6,076,600 | A | | 6/2000 | Vick, Jr. et al. |
| 6,079,496 | A | | 6/2000 | Hirth |
| 6,085,837 | A | | 7/2000 | Massinon et al. |
| 6,095,247 | A | | 8/2000 | Streich et al. |
| 6,119,783 | A | | 9/2000 | Parker et al. |
| 6,142,237 | A | | 11/2000 | Christmas et al. |
| 6,148,916 | A | * | 11/2000 | Sampson et al. ..... 166/297 |
| 6,155,350 | A | * | 12/2000 | Melenyzer ..... 166/374 |
| 6,161,622 | A | | 12/2000 | Robb et al. |
| 6,167,970 | B1 | | 1/2001 | Stout et al. |
| 6,173,779 | B1 | | 1/2001 | Smith |
| 6,189,616 | B1 | | 2/2001 | Gano et al. |
| 6,189,618 | B1 | | 2/2001 | Beeman et al. |
| 6,213,202 | B1 | | 4/2001 | Read, Jr. |
| 6,220,350 | B1 | | 4/2001 | Brothers et al. |
| 6,237,688 | B1 | | 5/2001 | Burleson et al. |
| 6,238,280 | B1 | | 5/2001 | Ritt et al. |
| 6,241,021 | B1 | | 6/2001 | Bowling |
| 6,250,392 | B1 | | 6/2001 | Muth |
| 6,273,187 | B1 | | 8/2001 | Voisin, Jr. et al. |
| 6,276,452 | B1 | | 8/2001 | Davis et al. |
| 6,276,457 | B1 | | 8/2001 | Moffatt et al. |
| 6,279,656 | B1 | | 8/2001 | Sinclair et al. |
| 6,287,445 | B1 | | 9/2001 | Lashmore et al. |
| 6,302,205 | B1 | | 10/2001 | Ryll |
| 6,315,041 | B1 | | 11/2001 | Carlisle et al. |
| 6,315,050 | B2 | | 11/2001 | Vaynshteyn et al. |
| 6,325,148 | B1 | | 12/2001 | Trahan et al. |
| 6,328,110 | B1 | | 12/2001 | Joubert |
| 6,341,653 | B1 | | 1/2002 | Firmaniuk et al. |
| 6,349,766 | B1 | | 2/2002 | Bussear et al. |
| 6,354,379 | B2 | | 3/2002 | Miszewski et al. |
| 6,371,206 | B1 | | 4/2002 | Mills |

6,382,244 B2 5/2002 Vann
6,390,195 B1 5/2002 Nguyen et al.
6,390,200 B1 5/2002 Allamon et al.
6,394,185 B1 5/2002 Constien
6,397,950 B1 6/2002 Streich et al.
6,403,210 B1 6/2002 Stuivinga et al.
6,408,946 B1 6/2002 Marshall et al.
6,419,023 B1 7/2002 George et al.
6,439,313 B1 8/2002 Thomeer et al.
6,457,525 B1 * 10/2002 Scott ..... 166/300
6,467,546 B2 10/2002 Allamon et al.
6,470,965 B1 10/2002 Winzer
6,491,116 B2 12/2002 Berscheidt et al.
6,513,598 B2 2/2003 Moore et al.
6,540,033 B1 4/2003 Sullivan et al.
6,543,539 B1 * 4/2003 Vinegar et al. ..... 166/296
6,543,543 B2 4/2003 Muth
6,561,275 B2 5/2003 Glass et al.
6,588,507 B2 7/2003 Dusterhoft et al.
6,591,915 B2 7/2003 Burris et al.
6,601,648 B2 8/2003 Ebinger
6,601,650 B2 8/2003 Sundararajan
6,613,383 B1 9/2003 George et al.
6,619,400 B2 9/2003 Brunet
6,634,428 B2 10/2003 Krauss et al.
6,662,886 B2 12/2003 Russell
6,675,889 B1 1/2004 Mullins et al.
6,713,177 B2 3/2004 George et al.
6,715,541 B2 4/2004 Pedersen et al.
6,719,051 B2 4/2004 Hailey, Jr. et al.
6,755,249 B2 6/2004 Robison et al.
6,776,228 B2 8/2004 Pedersen et al.
6,779,599 B2 8/2004 Mullins et al.
6,799,638 B2 10/2004 Butterfield, Jr.
6,810,960 B2 11/2004 Pia
6,817,414 B2 11/2004 Lee
6,831,044 B2 12/2004 Constien
6,883,611 B2 4/2005 Smith et al.
6,887,297 B2 5/2005 Winter et al.
6,896,061 B2 5/2005 Hriscu et al.
6,899,176 B2 5/2005 Hailey, Jr. et al.
6,913,827 B2 7/2005 George et al.
6,926,086 B2 8/2005 Patterson et al.
6,932,159 B2 8/2005 Hovem
6,939,388 B2 9/2005 Angeliu
6,945,331 B2 9/2005 Patel
6,959,759 B2 11/2005 Doane et al.
6,973,970 B2 12/2005 Johnston et al.
6,973,973 B2 12/2005 Howard et al.
6,983,796 B2 1/2006 Bayne et al.
6,986,390 B2 1/2006 Doane et al.
7,013,989 B2 3/2006 Hammond et al.
7,017,664 B2 3/2006 Walker et al.
7,021,389 B2 4/2006 Bishop et al.
7,025,146 B2 4/2006 King et al.
7,028,778 B2 4/2006 Krywitsky
7,044,230 B2 5/2006 Starr et al.
7,049,272 B2 5/2006 Sinclair et al.
7,051,805 B2 5/2006 Doane et al.
7,059,410 B2 6/2006 Bousche et al.
7,090,027 B1 8/2006 Williams
7,093,664 B2 8/2006 Todd et al.
7,096,945 B2 8/2006 Richards et al.
7,096,946 B2 8/2006 Jasser et al.
7,108,080 B2 9/2006 Tessari et al.
7,111,682 B2 9/2006 Blaisdell
7,150,326 B2 12/2006 Bishop et al.
7,163,066 B2 1/2007 Lehr
7,168,494 B2 1/2007 Starr et al.
7,174,963 B2 2/2007 Bertelsen
7,182,135 B2 2/2007 Szarka
7,210,527 B2 5/2007 Walker et al.
7,210,533 B2 5/2007 Starr et al.
7,234,530 B2 6/2007 Gass
7,250,188 B2 7/2007 Dodelet et al.
7,255,172 B2 8/2007 Johnson
7,255,178 B2 8/2007 Slup et al.
7,264,060 B2 9/2007 Wills
7,267,178 B2 9/2007 Krywitsky
7,270,186 B2 9/2007 Johnson
7,287,592 B2 10/2007 Surjaatmadja et al.
7,311,152 B2 12/2007 Howard et al.
7,320,365 B2 1/2008 Pia
7,322,412 B2 1/2008 Badalamenti et al.
7,325,617 B2 2/2008 Murray
7,328,750 B2 2/2008 Swor et al.
7,331,388 B2 2/2008 Vilela et al.
7,337,854 B2 3/2008 Horn et al.
7,346,456 B2 3/2008 Le Bemadjiel
7,353,879 B2 4/2008 Todd et al.
7,360,593 B2 4/2008 Constien
7,360,597 B2 4/2008 Blaisdell
7,387,165 B2 6/2008 Lopez de Cardenas et al.
7,426,964 B2 9/2008 Lynde et al.
7,441,596 B2 10/2008 Wood et al.
7,445,049 B2 11/2008 Howard et al.
7,451,815 B2 11/2008 Hailey, Jr.
7,451,817 B2 11/2008 Reddy et al.
7,461,699 B2 12/2008 Richard et al.
7,464,758 B2 * 12/2008 Yeo et al. ..... 166/285
7,464,764 B2 12/2008 Xu
7,472,750 B2 1/2009 Walker et al.
7,478,676 B2 1/2009 East, Jr. et al.
7,503,399 B2 3/2009 Badalamenti et al.
7,509,993 B1 3/2009 Turng et al.
7,510,018 B2 3/2009 Williamson et al.
7,513,311 B2 4/2009 Gramstad et al.
7,527,103 B2 5/2009 Huang et al.
7,552,777 B2 6/2009 Murray et al.
7,552,779 B2 6/2009 Murray
7,559,357 B2 7/2009 Clem
7,575,062 B2 8/2009 East, Jr.
7,591,318 B2 9/2009 Tilghman
7,600,572 B2 10/2009 Slup et al.
7,635,023 B2 12/2009 Goldberg et al.
7,640,988 B2 1/2010 Phi et al.
7,661,480 B2 2/2010 Al-Anazi
7,661,481 B2 2/2010 Todd et al.
7,665,537 B2 2/2010 Patel et al.
7,686,082 B2 3/2010 Marsh
7,690,436 B2 4/2010 Turley et al.
7,699,101 B2 4/2010 Fripp et al.
7,703,511 B2 4/2010 Buyers et al.
7,708,078 B2 5/2010 Stoesz
7,709,421 B2 5/2010 Jones et al.
7,712,541 B2 5/2010 Loretz et al.
7,726,406 B2 6/2010 Xu
7,757,773 B2 7/2010 Rytlewski
7,762,342 B2 7/2010 Richard et al.
7,770,652 B2 8/2010 Barnett
7,775,284 B2 8/2010 Richards et al.
7,775,286 B2 8/2010 Duphorne
7,784,543 B2 8/2010 Johnson
7,798,225 B2 9/2010 Giroux et al.
7,798,226 B2 9/2010 Themig
7,798,236 B2 9/2010 McKeachnie et al.
7,806,189 B2 10/2010 Frazier
7,806,192 B2 10/2010 Foster et al.
7,810,553 B2 10/2010 Cruickshank et al.
7,810,567 B2 10/2010 Daniels et al.
7,819,198 B2 10/2010 Birckhead et al.
7,828,055 B2 11/2010 Willauer et al.
7,833,944 B2 11/2010 Munoz et al.
7,849,927 B2 12/2010 Herrera
7,855,168 B2 12/2010 Fuller et al.
7,861,781 B2 1/2011 D'Arcy
7,874,365 B2 1/2011 East, Jr. et al.
7,878,253 B2 2/2011 Stowe et al.
7,896,091 B2 3/2011 Williamson et al.
7,897,063 B1 3/2011 Perry et al.
7,900,696 B1 3/2011 Nish et al.
7,900,703 B2 3/2011 Clark et al.
7,909,096 B2 3/2011 Clark et al.
7,909,104 B2 3/2011 Bjorgum
7,909,110 B2 3/2011 Sharma et al.
7,913,765 B2 3/2011 Crow et al.
7,931,093 B2 4/2011 Foster et al.
7,938,191 B2 5/2011 Vaidya 7,946,340 B2 5/2011 Surjaatmadja et al.
7,958,940 B2 6/2011 Jameson
7,963,331 B2 6/2011 Surjaatmadja et al.
7,963,340 B2 6/2011 Gramstad et al.
7,963,342 B2 6/2011 George
7,980,300 B2 7/2011 Roberts et al.
7,987,906 B1 8/2011 Troy
8,020,619 B1 9/2011 Robertson et al.
8,020,620 B2 9/2011 Daniels et al.
8,025,104 B2 9/2011 Cooke, Jr.
8,028,767 B2 10/2011 Radford et al.
8,033,331 B2 10/2011 Themig
8,039,422 B1 10/2011 Al-Zahrani
8,056,628 B2 11/2011 Whitsitt et al.
8,056,638 B2 11/2011 Clayton et al.
2001/0045285 A1 11/2001 Russell
2001/0045288 A1 11/2001 Allamon et al.
2002/0000319 A1 1/2002 Brunet
2002/0007948 A1 1/2002 Bayne et al.
2002/0014268 A1 2/2002 Vann
2002/0066572 A1 6/2002 Muth
2002/0104616 A1 8/2002 De et al.
2002/0136904 A1 9/2002 Glass et al.
2002/0162661 A1 11/2002 Krauss et al.
2003/0019623 A1* 1/2003 King et al. ..... 166/120
2003/0037925 A1 2/2003 Walker et al.
2003/0075326 A1 4/2003 Ebinger
2003/0111728 A1 6/2003 Thai et al.
2003/0141060 A1 7/2003 Hailey et al.
2003/0141061 A1 7/2003 Hailey et al.
2003/0141079 A1 7/2003 Doane et al.
2003/0150614 A1 8/2003 Brown et al.
2003/0155114 A1 8/2003 Pedersen et al.
2003/0155115 A1 8/2003 Pedersen et al.
2003/0159828 A1 8/2003 Howard et al.
2003/0164237 A1 9/2003 Butterfield
2003/0183391 A1 10/2003 Hriscu et al.
2004/0005483 A1 1/2004 Lin
2004/0020832 A1 2/2004 Richards et al.
2004/0045723 A1 3/2004 Slup et al.
2004/0060707 A1* 4/2004 Bearden et al. ..... 166/380
2004/0089449 A1 5/2004 Walton et al.
2004/0159428 A1 8/2004 Hammond et al.
2004/0182583 A1 9/2004 Doane et al.
2004/0231845 A1* 11/2004 Cooke, Jr. ..... 166/279
2004/0256109 A1 12/2004 Johnson
2004/0256157 A1 12/2004 Tessari et al.
2005/0034876 A1 2/2005 Doane et al.
2005/0051329 A1 3/2005 Blaisdell
2005/0092363 A1* 5/2005 Richard et al. ..... 137/73
2005/0102255 A1 5/2005 Bultman
2005/0165149 A1 7/2005 Chanak et al.
2005/0205265 A1 9/2005 Todd et al.
2005/0205266 A1 9/2005 Todd et al.
2005/0241824 A1 11/2005 Burris, II et al.
2005/0241825 A1 11/2005 Burris, II et al.
2005/0257936 A1 11/2005 Lehr
2006/0012087 A1 1/2006 Matsuda et al.
2006/0045787 A1 3/2006 Jandeska et al.
2006/0057479 A1 3/2006 Niimi et al.
2006/0081378 A1 4/2006 Howard et al.
2006/0102871 A1 5/2006 Wang et al.
2006/0108126 A1 5/2006 Horn et al.
2006/0116696 A1 6/2006 Odermatt et al.
2006/0124310 A1 6/2006 Lopez de Cardenas et al.
2006/0131011 A1 6/2006 Lynde et al.
2006/0134312 A1 6/2006 Dekker et al.
2006/0144515 A1 7/2006 Tada et al.
2006/0151178 A1 7/2006 Howard et al.
2006/0162927 A1 7/2006 Walker et al.
2006/0213670 A1 9/2006 Bishop et al.
2006/0231253 A1 10/2006 Vilela et al.
2006/0283592 A1 12/2006 Sierra et al.
2007/0017674 A1 1/2007 Blaisdell
2007/0017675 A1 1/2007 Hammami et al.
2007/0029082 A1 2/2007 Giroux et al.
2007/0039741 A1 2/2007 Hailey
2007/0044966 A1 3/2007 Davies et al.
2007/0051521 A1 3/2007 Fike et al.
2007/0054101 A1 3/2007 Sigalas et al.
2007/0062644 A1 3/2007 Nakamura et al.
2007/0108060 A1 5/2007 Park
2007/0119600 A1 5/2007 Slup et al.
2007/0131912 A1 6/2007 Simone et al.
2007/0151009 A1 7/2007 Conrad, III et al.
2007/0151769 A1 7/2007 Slutz et al.
2007/0169935 A1* 7/2007 Akbar et al. ..... 166/284
2007/0185655 A1 8/2007 Le Bemadjiel
2007/0187095 A1 8/2007 Walker et al.
2007/0221373 A1 9/2007 Murray
2007/0221384 A1 9/2007 Murray
2007/0261862 A1 11/2007 Murray
2007/0272411 A1 11/2007 Lopez De Cardenas et al.
2007/0272413 A1 11/2007 Rytlewski et al.
2007/0277979 A1 12/2007 Todd et al.
2007/0284109 A1* 12/2007 East et al. ..... 166/305.1
2007/0299510 A1 12/2007 Venkatraman et al.
2008/0047707 A1 2/2008 Boney et al.
2008/0060810 A9 3/2008 Nguyen et al.
2008/0066923 A1* 3/2008 Xu ..... 166/376
2008/0066924 A1 3/2008 Xu
2008/0078553 A1 4/2008 George
2008/0099209 A1 5/2008 Loretz et al.
2008/0115932 A1 5/2008 Cooke
2008/0149325 A1 6/2008 Crawford
2008/0149345 A1* 6/2008 Marya et al. ..... 166/376
2008/0169105 A1 7/2008 Williamson et al.
2008/0179104 A1 7/2008 Zhang et al.
2008/0202764 A1 8/2008 Clayton et al.
2008/0223586 A1 9/2008 Barnett
2008/0223587 A1 9/2008 Cherewyk
2008/0236829 A1 10/2008 Lynde
2008/0248205 A1 10/2008 Blanchet et al.
2008/0277109 A1 11/2008 Vaidya
2008/0277980 A1 11/2008 Koda et al.
2008/0296024 A1* 12/2008 Huang et al. ..... 166/311
2008/0314581 A1 12/2008 Brown
2009/0032255 A1* 2/2009 Surjaatmadja et al. ..... 166/281
2009/0044946 A1 2/2009 Schasteen et al.
2009/0044949 A1 2/2009 King et al.
2009/0084550 A1 4/2009 Korte et al.
2009/0084556 A1 4/2009 Richards et al.
2009/0107684 A1 4/2009 Cooke, Jr.
2009/0145666 A1 6/2009 Radford et al.
2009/0159289 A1 6/2009 Avant et al.
2009/0178808 A1 7/2009 Williamson et al.
2009/0194273 A1 8/2009 Surjaatmadja et al.
2009/0205841 A1 8/2009 Kluge et al.
2009/0242202 A1 10/2009 Rispler et al.
2009/0242208 A1 10/2009 Bolding
2009/0242214 A1 10/2009 Foster et al.
2009/0255686 A1 10/2009 Richard et al.
2009/0260817 A1 10/2009 Gambier et al.
2009/0272544 A1 11/2009 Giroux et al.
2009/0283270 A1 11/2009 Langeslag
2009/0301730 A1 12/2009 Gweily
2009/0308588 A1 12/2009 Howell et al.
2009/0317556 A1 12/2009 Macary
2010/0015002 A1 1/2010 Barrera et al.
2010/0032151 A1 2/2010 Duphorne
2010/0044041 A1 2/2010 Smith et al.
2010/0051278 A1 3/2010 Mytopher et al.
2010/0089583 A1 4/2010 Xu et al.
2010/0089587 A1 4/2010 Stout
2010/0101803 A1 4/2010 Clayton et al.
2010/0139930 A1 6/2010 Patel et al.
2010/0200230 A1 8/2010 East, Jr. et al.
2010/0236793 A1 9/2010 Bjorgum
2010/0236794 A1 9/2010 Duan et al.
2010/0243254 A1 9/2010 Murphy et al.
2010/0252273 A1 10/2010 Duphorne
2010/0252280 A1 10/2010 Swor et al.
2010/0270031 A1 10/2010 Patel
2011/0005773 A1 1/2011 Dusterhoft et al.
2011/0036592 A1 2/2011 Fay
2011/0048743 A1 3/2011 Stafford et al.
2011/0056692 A1 3/2011 Lopez de Cardenas et al.
2011/0067872 A1 3/2011 Agrawal

| | | | | |
|---|---|---|---|---|
| 2011/0067889 | A1 | 3/2011 | Marya et al. | |
| 2011/0067890 | A1 | 3/2011 | Themig | |
| 2011/0100643 | A1 | 5/2011 | Themig et al. | |
| 2011/0127044 | A1 | 6/2011 | Radford et al. | |
| 2011/0132143 | A1 * | 6/2011 | Xu et al. | 75/232 |
| 2011/0132612 | A1 | 6/2011 | Agrawal et al. | |
| 2011/0132619 | A1 | 6/2011 | Agrawal et al. | |
| 2011/0132620 | A1 | 6/2011 | Agrawal et al. | |
| 2011/0132621 | A1 | 6/2011 | Agrawal et al. | |
| 2011/0135530 | A1 | 6/2011 | Xu et al. | |
| 2011/0135805 | A1 | 6/2011 | Doucet et al. | |
| 2011/0135953 | A1 | 6/2011 | Xu et al. | |
| 2011/0136707 | A1 | 6/2011 | Xu et al. | |
| 2011/0139465 | A1 | 6/2011 | Tibbles et al. | |
| 2011/0147014 | A1 | 6/2011 | Chen et al. | |
| 2011/0186306 | A1 | 8/2011 | Marya et al. | |
| 2011/0247833 | A1 | 10/2011 | Todd et al. | |
| 2011/0253387 | A1 | 10/2011 | Ervin | |
| 2011/0259610 | A1 | 10/2011 | Shkurti et al. | |
| 2011/0277987 | A1 | 11/2011 | Frazier | |
| 2011/0277989 | A1 | 11/2011 | Frazier | |
| 2011/0284232 | A1 | 11/2011 | Huang | |
| 2011/0284243 | A1 | 11/2011 | Frazier | |

FOREIGN PATENT DOCUMENTS

| | | | |
|---|---|---|---|
| JP | 2004225084 | | 8/2004 |
| JP | 2004225765 | A | 8/2004 |
| JP | 2005076052 | A | 3/2005 |
| JP | 2010502840 | A | 1/2010 |
| WO | 2008057045 | A1 | 5/2008 |
| WO | W02008079485 | | 7/2008 |
| WO | 2009079745 | A1 | 7/2009 |

OTHER PUBLICATIONS

Optisleeve Sliding Sleeve, [online]; [retrieved on Jun. 25, 2010]; retrieved from the Internet weatherford.com/weatherford/groups/.../weatherfordcorp/WFT033159.pdf.

"Sliding Sleeve", Omega Completion Technology Ltd, Sep. 29, 2009, retrieved on: www.omega-completion.com.

Welch, William R. et al., "Nonelastomeric Sliding Sleeve Maintains Long Term Integrity in HP/HT Application: Case Histories" [Abstract Only], SPE Eastern Regional Meeting, Oct. 23-25, 1996, Columbus. Ohio.

E. Paul Bercegeay et al., "A One-Trip Gravel Packing System"; Society of Petroleum Engineers, Offshort Technology Conference, SPE Paper No. 4771; Feb. 7-8, 1974.

Constantin Vahlas, Bri Gitte Caussat, Philippe Serp, George N. Angelopoulos, "Principles and Applications of CVD Powder Technology", Materials Science and Engineering R 53 (2006) 1-72.

Curtin, William and Brian Sheldon. "CNT-reinforced ceramics and metals," Materials Today, 2004, Vol-7, 44-49.

Yi Feng, Hailong Yuan, "Electroless Plating of Carbon Nanotubes with Silver" Journal of Materials Science, 39, (2004) pp. 3241-3243.

E. Flahaut et al., "Carbon Nanotube-Metal-Oxide Nanocomposites: Microstructure, Electrical Conductivity and Mechanical Properties" Acta mater. 48 (2000) 3803-3812.

Galanty et al. "Consolidation of metal powders during the extrusion process," Journal of Materials Processing Technology (2002), pp. 491-496.

C.S. Goh, J. Wei, L C Lee, and M. Gupta, "Development of novel carbon nanotube reinforced magnesium nanocomposites using the powder metallurgy technique", Nanotechnology 17 (2006) 7-12.

Hjortstam et al. "Can we achieve ultra-low resistivity in carbon nanotube-based metal composites," Applied Physics A (2004), vol. 78, Issue 8, pp. 1175-1179.

International Search Report and Written Opinion of the International Searching Authority, or the Declaration for PCT/US2011/058105 mailed from the Korean Intellectual Property Office on May 1, 2012.

Notification of Transmittal of the International Search Report and the Written Opinion of the International Searching Authority, or the Declaration mailed on Feb. 23, 2012 (Dated Feb. 22, 2012) for PCT/US2011/043036.

International Search Report and Written Opinion of the International Searching Authority for International Application No. PCT/US2011/058099 (filed on Oct. 27, 2011), mailed on May 11, 2012.

Notification of Transmittal of the International Search Report and the Written Opinion of the International Searching Authority; PCT/US2010/059259; International Searching Authority KIPO; Mailed Jun. 13, 2011.

Notification of Transmittal of The International Search Report and the Written Opinion of the International Searching Authority; PCT/US2010/059265; International Searching Authority KIPO; Mailed Jun. 16, 2011.

Notification of Transmittal of The International Search Report and the Written Opinion of the International Searching Authority; PCT/US2010/059268; International Searching Authority KIPO; Mailed Jun. 17, 2011.

J. Dutta Majumdar, B. Ramesh Chandra, B.L. Mordike, R. Galun, I. Manna, "Laser Surface Engineering of a Magnesium Alloy with AI + AI203", Surface and Coatings Technology 179 (2004) 297-305.

J.E. Gray, B. Luan, "Protective Coatings on Magnesium and Its Alloys—a Critical Review", Journal of Alloys and Compounds 336 (2002) 88-113.

Toru Kuzumaki, Osamu Ujiie, Hideki Ichinose, and Kunio Ito, "Mechanical Characteristics and Preparation of Carbon Nanotube Fiber-Reinforced Ti Composite", Advanced Engineering Materials, 2000, 2, No. 7.

Stephen P. Mathis, "Sand Management: A Review of Approaches and Concerns"; Society of Petroleum Engineers, SPE Paper No. 82240; SPE European Formation Damage Conference, The Hague, The Netherlands, May 13-14, 2003.

Xiaowu Nie, Patents of Methods to Prepare Intermetallic Matrix Composites: A Review, Recent Patents on Materials Science 2008, 1, 232-240, Department of Scientific Research, Hunan Railway College of Science and Technology, Zhuzhou, P.R. China.

Notification of Transmittal of the International Search Report and Written Opinion, Mailed Jul. 8, 2011, International Appln. No. PCT/US2010/059263, Written Opinion 4 pages, International Search Report 3 pages.

Shimizu et al., "Multi-walled carbon nanotube-reinforced magnesium alloy composites", Scripta Materialia, vol. 58, Issue 4, pp. 267-270.

Song, G. And S. Song. "A Possible Biodegradable Magnesium Implant Material," Advanced Engineering Materials, vol. 9, Issue 4, Apr. 2007, pp. 298-302.

Jing Sun, Lian Gao, Wei Li, "Colloidal Processing of Carbon Nanotube/Alumina Composites" Chem. Mater. 2002, 14, 5169-5172.

Xiaotong Wang et al., "Contact-Damage-Resistant Ceramic/Single-Wall Carbon Nanotubes and Ceramic/Graphite Composites" Nature Materials, vol. 3, Aug. 2004, pp. 539-544.

Y. Zhang and Hongjie Dai, "Formation of metal nanowires on suspended single-walled carbon nanotubes" Applied Physics Letter, vol. 77, No. 19 (2000), pp. 3015-3017.

Zeng et al. "Progress and Challenge for Magnesium Alloys as Biomaterials," Advanced Engineering Materials, vol. 10, Issue 8, Aug. 2008, pp. B3-B14.

Guo-Dong Zhan, Joshua D. Kuntz, Julin Wan and Amiya K. Mukherjee, "Single-wall carbon nanotubes as attractive toughening agents in alumina-based nanocomposites" Nature Materials, vol. 2., Jan. 2003. 38-42.

Y. Zhang, Nathan W. Franklin, Robert J. Chen, Hongjie Dai, "Metal Coating on Suspended Carbon Nanotubes and its Implication to Metal—Tube Interaction", Chemical Physics Letters 331 (2000) 35-41.

Patent Cooperation Treaty International Search Report and Written Opinion for International Patent Application No. PCT/US2012/034978 filed on Apr. 25, 2012, mailed on Nov. 12, 2012.

International Search Report and Written Opinion for International application No. PCT/US2012/034973 filed on Apr. 25, 2012, mailed on Nov. 29, 2012.

* cited by examiner

FLOW CONTROL ARRANGEMENT AND METHOD

BACKGROUND

In the drilling and completion arts it has long been known to place openings in a tubular string to provide fluidic access through the tubular string in a generally radial direction. Stated alternatively, such openings allow fluidic communication between an inside dimension flow channel and an annulus created between the tubular string and a borehole wall (casing or open hole). It has also been known for an extended period to use openable and closable valves in concert with such openings to selectively prevent the fluid movement noted above.

A ubiquitously used and relied upon example of the foregoing is a sliding sleeve arrangement. One of ordinary skill in the art will be immediately familiar with the terms sliding sleeve and recognize that such an arrangement includes a housing having an opening, a sleeve translatable relative to the housing to either misalign entirely with the opening or to align a port with the opening, and a spring to bias the sleeve to a selected position (open or closed).

Commonly the arrangement noted is run in the hole with the sleeve in a closed position; operations are undertaken; the sleeve is opened with a tool run separately for the purpose of opening the sleeve; other operations are undertaken; and another run is employed to close the sleeve. This process is well accepted and oft used.

Since each run into the borehole is a costly affair, the art is always receptive reductions in the number of runs required for a given set of operations.

SUMMARY

A flow control arrangement includes a housing defining one or more openings therein; a valve structure alignable and misalignable with the one or more openings in the housing; and one or more plugs, one each in each of the one or more openings, each plug being reducible by one or more of exposure to downhole fluids and applied dissolution fluids.

A method for carrying out a series of downhole operations with a reduced number of mechanical intervention runs including running the arrangement of a housing defining one or more openings therein; a valve structure alignable and misalignable with the one or more openings in the housing; and one or more plugs, one each in each of the one or more openings, each plug being reducible by one or more of exposure to downhole fluids and applied dissolution fluids to a target depth; carrying out a downhole operation requiring the housing be radially permeability fluid restricted; reducing the plug; carrying out a downhole operation requiring fluid pressure communication through the one or more openings; and mechanically intervening to close the valve structure thereby rendering the one or more openings of the arrangement radially impermeable.

BRIEF DESCRIPTION OF THE DRAWINGS

Referring now to the drawings wherein like elements are numbered alike in the several Figures.

DETAILED DESCRIPTION

Figure 1:
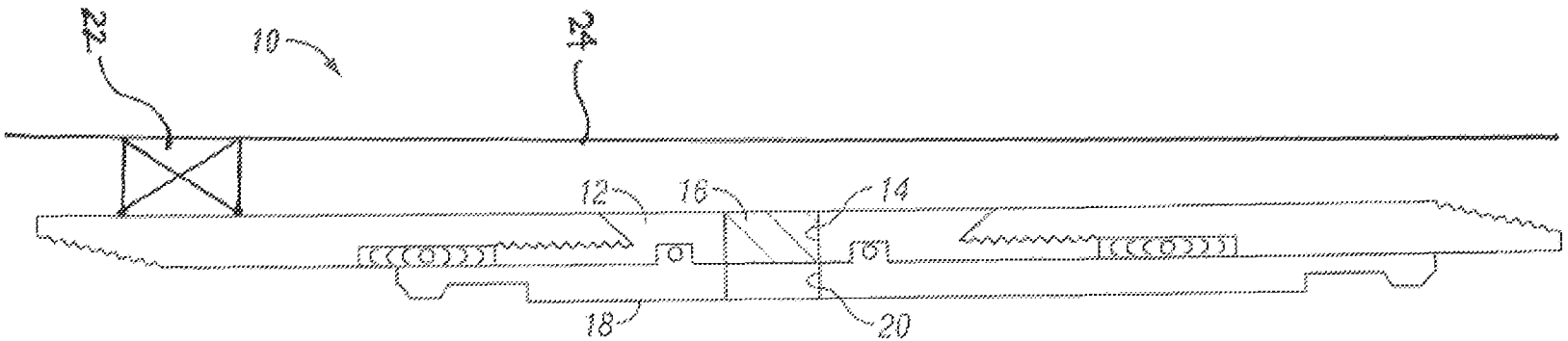
FIG. 1 is a schematic cross sectional view of a flow control arrangement in accordance with the disclosure hereof.

Referring to FIG. 1, a flow control arrangement 10 is illustrated to comprise a housing 12 having one or more openings 14. The one or more openings 14 are temporarily rendered fluid restrictive by plug 16. The degree of fluid permeability permitted is related to the operations that will be carried out utilizing the plug 16. Fluid permeability will range from impermeable to any selected permeability. Finally, the arrangement 10 includes a valve structure 18, which may in one embodiment be a sliding sleeve as illustrated. The sliding sleeve 18 in the illustrated embodiment further includes one or more ports 20 alignable and misalignable with the one or more openings 14, as desired. The flow control arrangement 10 is securable by a packer 22 against a borehole wall 24.

The plug(s) 16 may be constructed of a number of materials including but not limited to dissolvable metals such as magnesium, aluminum, magnesium alloy, aluminum alloy, etc., dissolvable polymeric materials such as the polymer HYDROCENE™ available from 5 droplax, S.r.l. located in Altopascia, Italy, polylactide ("PLA") polymer 4060D from Nature-Works™, a division of Cargill Dow LLC; TLF-6267 polyglycolic acid ("PGA") from DuPont Specialty Chemicals; polycaprolactams and mixtures of PLA and PGA; solid acids, such as sulfamic acid, trichloroacetic acid, and citric acid, held together with a wax or other suitable binder material; polyethylene homopolymers and paraffin waxes; polyalkylene oxides, such as polyethylene oxides, and polyalkylene glycols, such as polyethylene glycols (these polymers may be preferred in water-based drilling fluids because they are slowly soluble in water), and natural materials such as limestone, etc. each of which being selectable and/or configurable to be reducible (i.e. degradable in a range of allowing some permeability to complete dissolution of the plug) based upon one or more of exposure to naturally occurring downhole fluids and exposure to selectively distributed fluids. For example, selected materials may dissolve after exposure to natural well fluids drilling mud or acids, after a selected period of time. One engineered material contemplated for use as plug(s) 16 is a dissolvable high strength material. These lightweight, high-strength and selectably and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in wellbore applications. These powder compacts provide a unique and advantageous combination of mechanical strength properties, such as compression and shear strength, low density and selectable and controllable corrosion properties, particularly rapid and controlled dissolution in various wellbore fluids. For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials. As yet another example, these powders and powder compact materials may be configured to provide a selectable and controllable degradation or disposal in response to a change in an environmental condition, such as a transition from a very low dissolution rate to a very rapid dissolution rate in response to a change in a property or condition of a wellbore proximate an article formed from the compact, including a property change in a wellbore fluid that is in contact with the powder compact. The selectable and controllable degradation or disposal characteristics described also allow the dimensional stability and strength of articles, such as wellbore tools or other components, made from these materials to be maintained until they are no longer needed, at which time a predetermined environmental condition, such as a wellbore condition, including wellbore fluid temperature, pressure or pH value, may be changed to promote their removal by rapid dissolution. These coated powder materials and powder compacts and engineered materials formed from them, as well as methods of making them, are described further below.

Figure 2:
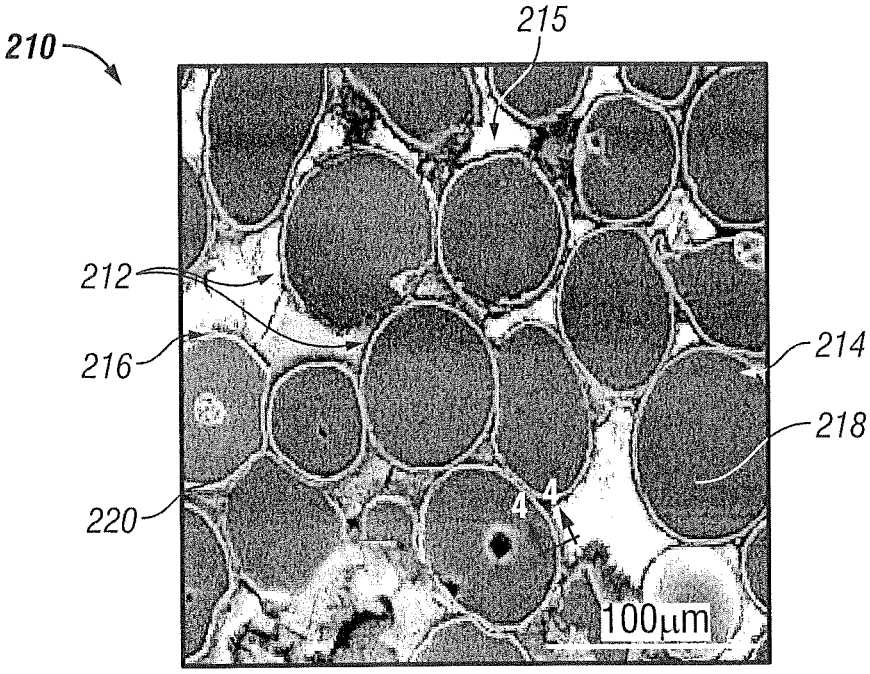
FIG. 2 is a photomicrograph of a powder 210 as disclosed herein that has been embedded in a potting material and sectioned.

Referring to FIG. 2, a metallic powder 210 includes a plurality of metallic, coated powder particles 212. Powder particles 212 may be formed to provide a powder 210, including free-flowing powder, that may be poured or otherwise disposed in all manner of forms or molds (not shown) having all manner of shapes and sizes and that may be used to fashion powder compacts 400 (FIGS. 5 and 6), as described herein, that may be used as, or for use in manufacturing, various articles of manufacture, including various wellbore tools and components.

Each of the metallic, coated powder particles 212 of powder 210 includes a particle core 214 and a metallic coating layer 216 disposed on the particle core 214. The particle core 214 includes a core material 218. The core material 218 may include any suitable material for forming the particle core 214 that provides powder particle 212 that can be sintered to form a lightweight, high-strength powder compact 400 having selectable and controllable dissolution characteristics. Suitable core materials include electrochemically active metals having a standard oxidation potential greater than or equal to that of Zn, including as Mg, Al, Mn or Zn or a combination thereof. These electrochemically active metals are very reactive with a number of common wellbore fluids, including any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). Core material 218 may also include other metals that are less electrochemically active than Zn or non-metallic materials, or a combination thereof. Suitable non-metallic materials include ceramics, composites, glasses or carbon, or a combination thereof. Core material 218 may be selected to provide a high dissolution rate in a predetermined wellbore fluid, but may also be selected to provide a relatively low dissolution rate, including zero dissolution, where dissolution of the nanomatrix material causes the particle core 214 to be rapidly undermined and liberated from the particle compact at the interface with the wellbore fluid, such that the effective rate of dissolution of particle compacts made using particle cores 214 of these core materials 218 is high, even though core material 218 itself may have a low dissolution rate, including core materials 220 that may be substantially insoluble in the wellbore fluid.

With regard to the electrochemically active metals as core materials 218, including Mg, Al, Mn or Zn, these metals may be used as pure metals or in any combination with one another, including various alloy combinations of these materials, including binary, tertiary, or quaternary alloys of these materials. These combinations may also include composites of these materials. Further, in addition to combinations with one another, the Mg, Al, Mn or Zn core materials 18 may also include other constituents, including various alloying additions, to alter one or more properties of the particle cores 214, such as by improving the strength, lowering the density or altering the dissolution characteristics of the core material 218.

Among the electrochemically active metals, Mg, either as a pure metal or an alloy or a composite material, is particularly useful, because of its low density and ability to form high-strength alloys, as well as its high degree of electrochemical activity, since it has a standard oxidation potential higher than Al, Mn or Zn. Mg alloys include all alloys that have Mg as an alloy constituent. Mg alloys that combine other electrochemically active metals, as described herein, as alloy constituents are particularly useful, including binary Mg—Zn, Mg—Al and Mg—Mn alloys, as well as tertiary Mg—Zn—Y and Mg—Al—X alloys, where X includes Zn, Mn, Si, Ca or Y, or a combination thereof. These Mg—Al—X alloys may include, by weight, up to about 85% Mg, up to about 15% Al and up to about 5% X. Particle core 214 and core material 218, and particularly electrochemically active metals including Mg, Al, Mn or Zn, or combinations thereof, may also include a rare earth element or combination of rare earth elements. As used herein, rare earth elements include Sc, Y, La, Ce, Pr, Nd or Er, or a combination of rare earth elements. Where present, a rare earth element or combinations of rare earth elements may be present, by weight, in an amount of about 5% or less.

Particle core 214 and core material 218 have a melting temperature ($T_P$). As used herein, $T_P$ includes the lowest temperature at which incipient melting or liquation or other forms of partial melting occur within core material 218, regardless of whether core material 218 comprises a pure metal, an alloy with multiple phases having different melting temperatures or a composite of materials having different melting temperatures.

Particle cores 214 may have any suitable particle size or range of particle sizes or distribution of particle sizes. For example, the particle cores 214 may be selected to provide an average particle size that is represented by a normal or Gaussian type unimodal distribution around an average or mean, as illustrated generally in FIG. 2. In another example, particle cores 214 may be selected or mixed to provide a multimodal distribution of particle sizes, including a plurality of average particle core sizes, such as, for example, a homogeneous bimodal distribution of average particle sizes. The selection of the distribution of particle core size may be used to determine, for example, the particle size and interparticle spacing 215 of the particles 212 of powder 210. In an exemplary embodiment, the particle cores 214 may have a unimodal distribution and an average particle diameter of about 5 μm to about 300 μm, more particularly about 80 μm to about 120 μm, and even more particularly about 100 μm.

Particle cores 214 may have any suitable particle shape, including any regular or irregular geometric shape, or combination thereof. In an exemplary embodiment, particle cores 214 are substantially spheroidal electrochemically active metal particles. In another exemplary embodiment, particle cores 214 are substantially irregularly shaped ceramic particles. In yet another exemplary embodiment, particle cores 214 are carbon or other nanotube structures or hollow glass microspheres.

Figure 3:
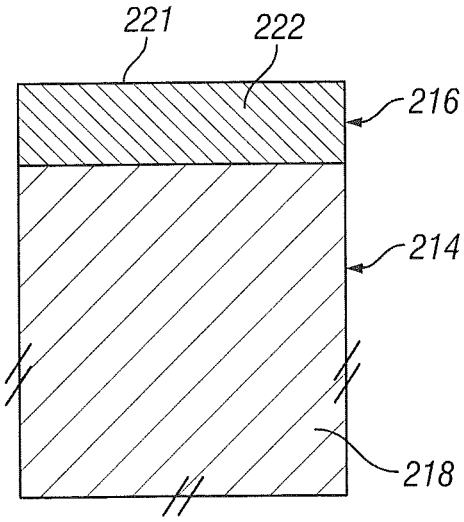
FIG. 3 is a schematic illustration of an exemplary embodiment of a powder particle 12 as it would appear in an exemplary section view represented by section 4-4 of FIG. 3.

Each of the metallic, coated powder particles 212 of powder 210 also includes a metallic coating layer 216 that is disposed on particle core 214. Metallic coating layer 216 includes a metallic coating material 220. Metallic coating material 220 gives the powder particles 212 and powder 210 its metallic nature. Metallic coating layer 216 is a nanoscale coating layer. In an exemplary embodiment, metallic coating layer 216 may have a thickness of about 25 nm to about 2500 nm. The thickness of metallic coating layer 216 may vary over the surface of particle core 214, but will preferably have a substantially uniform thickness over the surface of particle core 214. Metallic coating layer 216 may include a single layer, as illustrated in FIG. 3, or a plurality of layers as a multilayer coating structure. In a single layer coating, or in each of the layers of a multilayer coating, the metallic coating layer 216 may include a single constituent chemical element or compound, or may include a plurality of chemical elements or compounds. Where a layer includes a plurality of chemical constituents or compounds, they may have all manner of homogeneous or heterogeneous distributions, including a homogeneous or heterogeneous distribution of metallurgical phases. This may include a graded distribution where the relative amounts of the chemical constituents or compounds vary according to respective constituent profiles across the thickness of the layer. In both single layer and multilayer coatings 216, each of the respective layers, or combinations of them, may be used to provide a predetermined property to the powder particle 212 or a sintered powder compact formed therefrom. For example, the predetermined property may include the bond strength of the metallurgical bond between the particle core 214 and the coating material 220; the interdiffusion characteristics between the particle core 214 and metallic coating layer 216, including any interdiffusion between the layers of a multilayer coating layer 216; the interdiffusion characteristics between the various layers of a multilayer coating layer 216; the interdiffusion characteristics between the metallic coating layer 216 of one powder particle and that of an adjacent powder particle 212; the bond strength of the metallurgical bond between the metallic coating layers of adjacent sintered powder particles 212, including the outermost layers of multilayer coating layers; and the electrochemical activity of the coating layer 216.

Metallic coating layer 216 and coating material 220 have a melting temperature ($T_C$). As used herein, $T_C$ includes the lowest temperature at which incipient melting or liquation or other forms of partial melting occur within coating material 220, regardless of whether coating material 220 comprises a pure metal, an alloy with multiple phases each having different melting temperatures or a composite, including a composite comprising a plurality of coating material layers having different melting temperatures.

Metallic coating material 220 may include any suitable metallic coating material 220 that provides a sinterable outer surface 221 that is configured to be sintered to an adjacent powder particle 212 that also has a metallic coating layer 216 and sinterable outer surface 221. In powders 210 that also include second or additional (coated or uncoated) particles 232, as described herein, the sinterable outer surface 221 of metallic coating layer 216 is also configured to be sintered to a sinterable outer surface 221 of second particles 232. In an exemplary embodiment, the powder particles 212 are sinterable at a predetermined sintering temperature ($T_S$) that is a function of the core material 218 and coating material 220, such that sintering of powder compact 400 is accomplished entirely in the solid state and where $T_S$ is less than $T_P$ and $T_C$. Sintering in the solid state limits particle core 214/metallic coating layer 216 interactions to solid state diffusion processes and metallurgical transport phenomena and limits growth of and provides control over the resultant interface between them. In contrast, for example, the introduction of liquid phase sintering would provide for rapid interdiffusion of the particle core 214/metallic coating layer 216 materials and make it difficult to limit the growth of and provide control over the resultant interface between them, and thus interfere with the formation of the desirable microstructure of particle compact 400 as described herein.

In an exemplary embodiment, core material 218 will be selected to provide a core chemical composition and the coating material 220 will be selected to provide a coating chemical composition and these chemical compositions will also be selected to differ from one another. In another exemplary embodiment, the core material 218 will be selected to provide a core chemical composition and the coating material 220 will be selected to provide a coating chemical composition and these chemical compositions will also be selected to differ from one another at their interface. Differences in the chemical compositions of coating material 220 and core material 218 may be selected to provide different dissolution rates and selectable and controllable dissolution of powder compacts 400 that incorporate them making them selectably and controllably dissolvable. This includes dissolution rates that differ in response to a changed condition in the wellbore, including an indirect or direct change in a wellbore fluid. In an exemplary embodiment, a powder compact 400 formed from powder 210 having chemical compositions of core material 218 and coating material 220 that make compact 400 is selectably dissolvable in a wellbore fluid in response to a changed wellbore condition that includes a change in temperature, change in pressure, change in flow rate, change in pH or change in chemical composition of the wellbore fluid, or a combination thereof. The selectable dissolution response to the changed condition may result from actual chemical reactions or processes that promote different rates of dissolution, but also encompass changes in the dissolution response that are associated with physical reactions or processes, such as changes in wellbore fluid pressure or flow rate.

Figure 4:
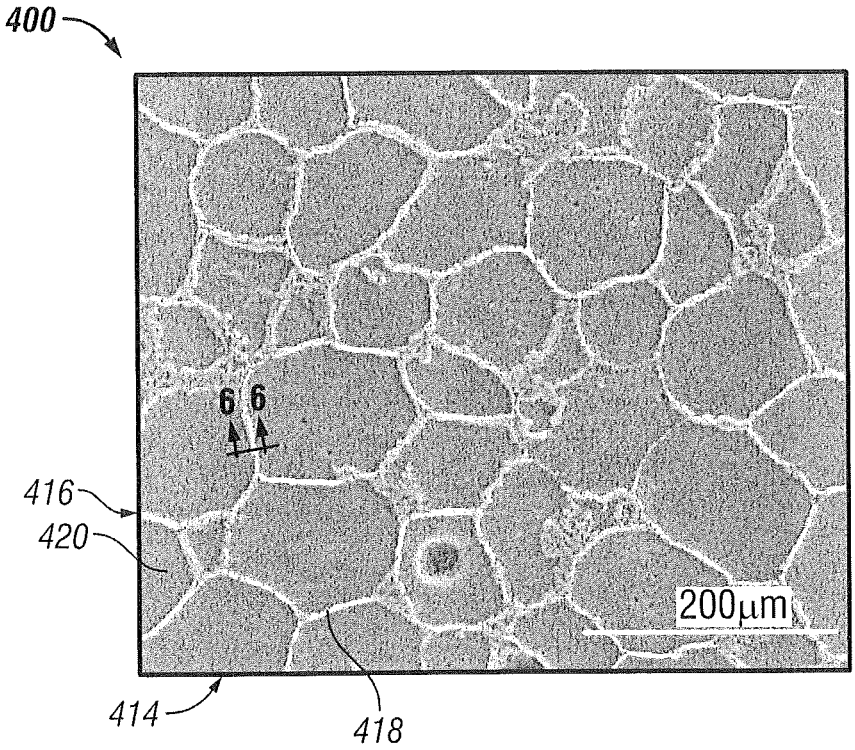
FIG. 4 is a photomicrograph of an exemplary embodiment of a powder compact as disclosed herein.

As illustrated in FIGS. 2 and 4, particle core 214 and core material 218 and metallic coating layer 216 and coating material 220 may be selected to provide powder particles 212 and a powder 210 that is configured for compaction and sintering to provide a powder compact 400 that is lightweight (i.e., having a relatively low density), high-strength and is selectably and controllably removable from a wellbore in response to a change in a wellbore property, including being selectably and controllably dissolvable in an appropriate wellbore fluid, including various wellbore fluids as disclosed herein. Powder compact 400 includes a substantially-continuous, cellular nanomatrix 416 of a nanomatrix material 420 having a plurality of dispersed particles 414 dispersed throughout the cellular nanomatrix 416. The substantially-continuous cellular nanomatrix 416 and nanomatrix material 420 formed of sintered metallic coating layers 216 is formed by the compaction and sintering of the plurality of metallic coating layers 216 of the plurality of powder particles 212. The chemical composition of nanomatrix material 420 may be different than that of coating material 220 due to diffusion effects associated with the sintering as described herein. Powder metal compact 400 also includes a plurality of dispersed particles 414 that comprise particle core material 418. Dispersed particle cores 414 and core material 418 correspond to and are formed from the plurality of particle cores 214 and core material 218 of the plurality of powder particles 212 as the metallic coating layers 216 are sintered together to form nanomatrix 416. The chemical composition of core material 418 may be different than that of core material 218 due to diffusion effects associated with sintering as described herein.

As used herein, the use of the term substantially-continuous cellular nanomatrix 416 does not connote the major constituent of the powder compact, but rather refers to the minority constituent or constituents, whether by weight or by volume. This is distinguished from most matrix composite materials where the matrix comprises the majority constituent by weight or volume. The use of the term substantially-continuous, cellular nanomatrix is intended to describe the extensive, regular, continuous and interconnected nature of the distribution of nanomatrix material 420 within powder compact 400. As used herein, "substantially-continuous" describes the extension of the nanomatrix material throughout powder compact 400 such that it extends between and envelopes substantially all of the dispersed particles 414. Substantially-continuous is used to indicate that complete continuity and regular order of the nanomatrix around each dispersed particle 414 is not required. For example, defects in the coating layer 216 over particle core 214 on some powder particles 212 may cause bridging of the particle cores 214 during sintering of the powder compact 400, thereby causing localized discontinuities to result within the cellular nanomatrix 416, even though in the other portions of the powder compact the nanomatrix is substantially continuous and exhibits the structure described herein. As used herein, "cellular" is used to indicate that the nanomatrix defines a network of generally repeating, interconnected, compartments or cells of nanomatrix material 420 that encompass and also interconnect the dispersed particles 414. As used herein, "nanomatrix" is used to describe the size or scale of the matrix, particularly the thickness of the matrix between adjacent dispersed particles 414. The metallic coating layers that are sintered together to form the nanomatrix are themselves nanoscale thickness coating layers. Since the nanomatrix at most locations, other than the intersection of more than two dispersed particles 414, generally comprises the interdiffusion and bonding of two coating layers 216 from adjacent powder particles 212 having nanoscale thicknesses, the matrix formed also has a nanoscale thickness (e.g., approximately two times the coating layer thickness as described herein) and is thus described as a nanomatrix. Further, the use of the term dispersed particles 414 does not connote the minor constituent of powder compact 400, but rather refers to the majority constituent or constituents, whether by weight or by volume. The use of the term dispersed particle is intended to convey the discontinuous and discrete distribution of particle core material 418 within powder compact 400.

Powder compact 400 may have any desired shape or size, including that of a cylindrical billet or bar that may be machined or otherwise used to form useful articles of manufacture, including various wellbore tools and components. The sintering and pressing processes used to form powder compact 400 and deform the powder particles 212, including particle cores 214 and coating layers 216, to provide the full density and desired macroscopic shape and size of powder compact 400 as well as its microstructure. The microstructure of powder compact 400 includes an equiaxed configuration of dispersed particles 414 that are dispersed throughout and embedded within the substantially-continuous, cellular nanomatrix 416 of sintered coating layers. This microstructure is somewhat analogous to an equiaxed grain microstructure with a continuous grain boundary phase, except that it does not require the use of alloy constituents having thermodynamic phase equilibria properties that are capable of producing such a structure. Rather, this equiaxed dispersed particle structure and cellular nanomatrix 416 of sintered metallic coating layers 216 may be produced using constituents where thermodynamic phase equilibrium conditions would not produce an equiaxed structure. The equiaxed morphology of the dispersed particles 414 and cellular network 416 of particle layers results from sintering and deformation of the powder particles 212 as they are compacted and interdiffuse and deform to fill the interparticle spaces 215 (FIG. 2). The sintering temperatures and pressures may be selected to ensure that the density of powder compact 400 achieves substantially full theoretical density.

Figure 5:
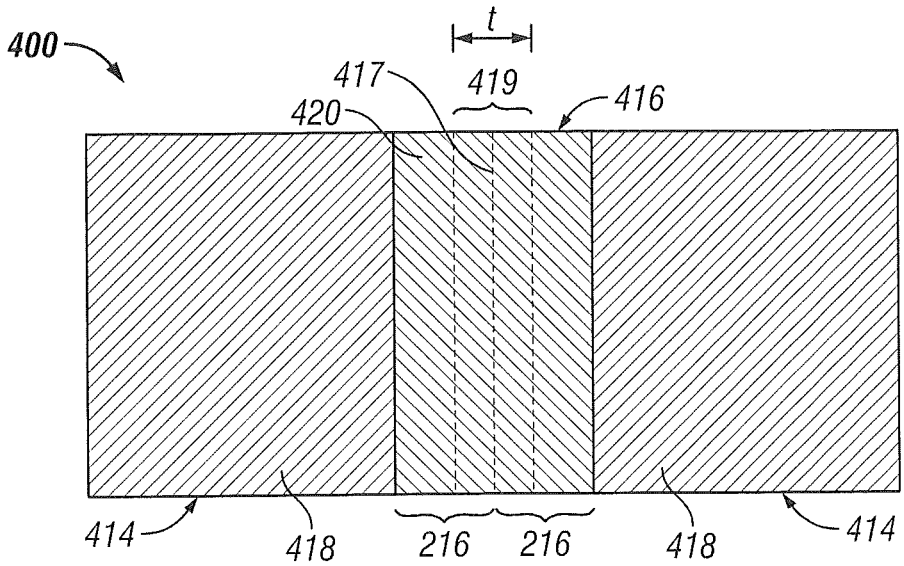
FIG. 5 is a schematic of illustration of an exemplary embodiment of a powder compact made using a powder having single-layer powder particles as it would appear taken along section 6-6 in FIG. 5.

In an exemplary embodiment as illustrated in FIGS. 2 and 4, dispersed particles 414 are formed from particle cores 214 dispersed in the cellular nanomatrix 416 of sintered metallic coating layers 216, and the nanomatrix 416 includes a solid-state metallurgical bond 417 or bond layer 419, as illustrated schematically in FIG. 5, extending between the dispersed particles 414 throughout the cellular nanomatrix 416 that is formed at a sintering temperature ($T_S$), where $T_S$ is less than $T_C$ and $T_P$. As indicated, solid-state metallurgical bond 417 is formed in the solid state by solid-state interdiffusion between the coating layers 216 of adjacent powder particles 212 that are compressed into touching contact during the compaction and sintering processes used to form powder compact 400, as described herein. As such, sintered coating layers 216 of cellular nanomatrix 416 include a solid-state bond layer 419 that has a thickness (t) defined by the extent of the interdiffusion of the coating materials 220 of the coating layers 216, which will in turn be defined by the nature of the coating layers 216, including whether they are single or multilayer coating layers, whether they have been selected to promote or limit such interdiffusion, and other factors, as described herein, as well as the sintering and compaction conditions, including the sintering time, temperature and pressure used to form powder compact 400.

As nanomatrix 416 is formed, including bond 417 and bond layer 419, the chemical composition or phase distribution, or both, of metallic coating layers 216 may change. Nanomatrix 416 also has a melting temperature ($T_M$). As used herein, $T_M$ includes the lowest temperature at which incipient melting or liquation or other forms of partial melting will occur within nanomatrix 416, regardless of whether nanomatrix material 420 comprises a pure metal, an alloy with multiple phases each having different melting temperatures or a composite, including a composite comprising a plurality of layers of various coating materials having different melting temperatures, or a combination thereof, or otherwise. As dispersed particles 414 and particle core materials 418 are formed in conjunction with nanomatrix 416, diffusion of constituents of metallic coating layers 216 into the particle cores 214 is also possible, which may result in changes in the chemical composition or phase distribution, or both, of particle cores 214. As a result, dispersed particles 414 and particle core materials 418 may have a melting temperature ($T_{DP}$) that is different than $T_P$. As used herein, $T_{DP}$ includes the lowest temperature at which incipient melting or liquation or other forms of partial melting will occur within dispersed particles 214, regardless of whether particle core material 218 comprise a pure metal, an alloy with multiple phases each having different melting temperatures or a composite, or otherwise. Powder compact 400 is formed at a sintering temperature ($T_S$), where $T_S$ is less than $T_C$, $T_P$, $T_M$ and $T_{DP}$.

Dispersed particles 414 may comprise any of the materials described herein for particle cores 214, even though the chemical composition of dispersed particles 414 may be different due to diffusion effects as described herein. In an exemplary embodiment, dispersed particles 414 are formed from particle cores 214 comprising materials having a standard oxidation potential greater than or equal to Zn, including Mg, Al, Zn or Mn, or a combination thereof, may include various binary, tertiary and quaternary alloys or other combinations of these constituents as disclosed herein in conjunction with particle cores 214. Of these materials, those having dispersed particles 414 comprising Mg and the nanomatrix 416 formed from the metallic coating materials 216 described herein are particularly useful. Dispersed particles 414 and particle core material 418 of Mg, Al, Zn or Mn, or a combination thereof, may also include a rare earth element, or a combination of rare earth elements as disclosed herein in conjunction with particle cores 214.

In another exemplary embodiment, dispersed particles 414 are formed from particle cores 214 comprising metals that are less electrochemically active than Zn or non-metallic materials. Suitable non-metallic materials include ceramics, glasses (e.g., hollow glass microspheres) or carbon, or a combination thereof, as described herein.

Dispersed particles 414 of powder compact 400 may have any suitable particle size, including the average particle sizes described herein for particle cores 214.

Dispersed particles 414 may have any suitable shape depending on the shape selected for particle cores 214 and powder particles 212, as well as the method used to sinter and compact powder 210. In an exemplary embodiment, powder particles 212 may be spheroidal or substantially spheroidal and dispersed particles 414 may include an equiaxed particle configuration as described herein.

The nature of the dispersion of dispersed particles 414 may be affected by the selection of the powder 210 or powders 210 used to make particle compact 400. In one exemplary embodiment, a powder 210 having a unimodal distribution of powder particle 212 sizes may be selected to form powder compact 220 and will produce a substantially homogeneous unimodal dispersion of particle sizes of dispersed particles 414 within cellular nanomatrix 416, as illustrated generally in FIG. 4. In another exemplary embodiment, a plurality of powders 210 having a plurality of powder particles with particle cores 214 that have the same core materials 218 and different core sizes and the same coating material 220 may be selected and uniformly mixed as described herein to provide a powder 210 having a homogenous, multimodal distribution of powder particle 212 sizes, and may be used to form powder compact 400 having a homogeneous, multimodal dispersion of particle sizes of dispersed particles 414 within cellular nanomatrix 416. Similarly, in yet another exemplary embodiment, a plurality of powders 210 having a plurality of particle cores 214 that may have the same core materials 218 and different core sizes and the same coating material 220 may be selected and distributed in a non-uniform manner to provide a non-homogenous, multimodal distribution of powder particle sizes, and may be used to form powder compact 400 having a non-homogeneous, multimodal dispersion of particle sizes of dispersed particles 414 within cellular nanomatrix 416. The selection of the distribution of particle core size may be used to determine, for example, the particle size and interparticle spacing of the dispersed particles 414 within the cellular nanomatrix 416 of powder compacts 400 made from powder 210.

Nanomatrix 416 is a substantially-continuous, cellular network of metallic coating layers 216 that are sintered to one another. The thickness of nanomatrix 416 will depend on the nature of the powder 210 or powders 210 used to form powder compact 400, as well as the incorporation of any second powder 230, particularly the thicknesses of the coating layers associated with these particles. In an exemplary embodiment, the thickness of nanomatrix 416 is substantially uniform throughout the microstructure of powder compact 400 and comprises about two times the thickness of the coating layers 216 of powder particles 212. In another exemplary embodiment, the cellular network 416 has a substantially uniform average thickness between dispersed particles 414 of about 50 nm to about 5000 nm.

Nanomatrix 416 is formed by sintering metallic coating layers 216 of adjacent particles to one another by interdiffusion and creation of bond layer 419 as described herein. Metallic coating layers 216 may be single layer or multilayer structures, and they may be selected to promote or inhibit diffusion, or both, within the layer or between the layers of metallic coating layer 216, or between the metallic coating layer 216 and particle core 214, or between the metallic coating layer 216 and the metallic coating layer 216 of an adjacent powder particle, the extent of interdiffusion of metallic coating layers 216 during sintering may be limited or extensive depending on the coating thicknesses, coating material or materials selected, the sintering conditions and other factors. Given the potential complexity of the interdiffusion and interaction of the constituents, description of the resulting chemical composition of nanomatrix 416 and nanomatrix material 420 may be simply understood to be a combination of the constituents of coating layers 216 that may also include one or more constituents of dispersed particles 414, depending on the extent of interdiffusion, if any, that occurs between the dispersed particles 414 and the nanomatrix 416. Similarly, the chemical composition of dispersed particles 414 and particle core material 418 may be simply understood to be a combination of the constituents of particle core 214 that may also include one or more constituents of nanomatrix 416 and nanomatrix material 420, depending on the extent of interdiffusion, if any, that occurs between the dispersed particles 414 and the nanomatrix 416.

In an exemplary embodiment, the nanomatrix material 420 has a chemical composition and the particle core material 418 has a chemical composition that is different from that of nanomatrix material 420, and the differences in the chemical compositions may be configured to provide a selectable and controllable dissolution rate, including a selectable transition from a very low dissolution rate to a very rapid dissolution rate, in response to a controlled change in a property or condition of the wellbore proximate the compact 400, including a property change in a wellbore fluid that is in contact with the powder compact 400, as described herein. Nanomatrix 416 may be formed from powder particles 212 having single layer and multilayer coating layers 216. This design flexibility provides a large number of material combinations, particularly in the case of multilayer coating layers 216, that can be utilized to tailor the cellular nanomatrix 416 and composition of nanomatrix material 420 by controlling the interaction of the coating layer constituents, both within a given layer, as well as between a coating layer 216 and the particle core 214 with which it is associated or a coating layer 216 of an adjacent powder particle 212. Several exemplary embodiments that demonstrate this flexibility are provided below.

As illustrated in FIG. 5, in an exemplary embodiment, powder compact 400 is formed from powder particles 212 where the coating layer 216 comprises a single layer, and the resulting nanomatrix 416 between adjacent ones of the plurality of dispersed particles 414 comprises the single metallic coating layer 216 of one powder particle 212, a bond layer 419 and the single coating layer 216 of another one of the adjacent powder particles 212. The thickness (t) of bond layer 419 is determined by the extent of the interdiffusion between the single metallic coating layers 216, and may encompass the entire thickness of nanomatrix 416 or only a portion thereof. In one exemplary embodiment of powder compact 400 formed using a single layer powder 210, powder compact 400 may include dispersed particles 414 comprising Mg, Al, Zn or Mn, or a combination thereof, as described herein, and nanomatrix 416 may include Al, Zn, Mn, Mg, Mo, W, Cu, Fe, Si, Ca, Co, Ta, Re or Ni, or an oxide, carbide or nitride thereof, or a combination of any of the aforementioned materials, including combinations where the nanomatrix material 420 of cellular nanomatrix 416, including bond layer 419, has a chemical composition and the core material 418 of dispersed particles 414 has a chemical composition that is different than the chemical composition of nanomatrix material 416. The difference in the chemical composition of the nanomatrix material 420 and the core material 418 may be used to provide selectable and controllable dissolution in response to a change in a property of a wellbore, including a wellbore fluid, as described herein. In a further exemplary embodiment of a powder compact 400 formed from a powder 210 having a single coating layer configuration, dispersed particles 414 include Mg, Al, Zn or Mn, or a combination thereof, and the cellular nanomatrix 416 includes Al or Ni, or a combination thereof.

Figure 6:
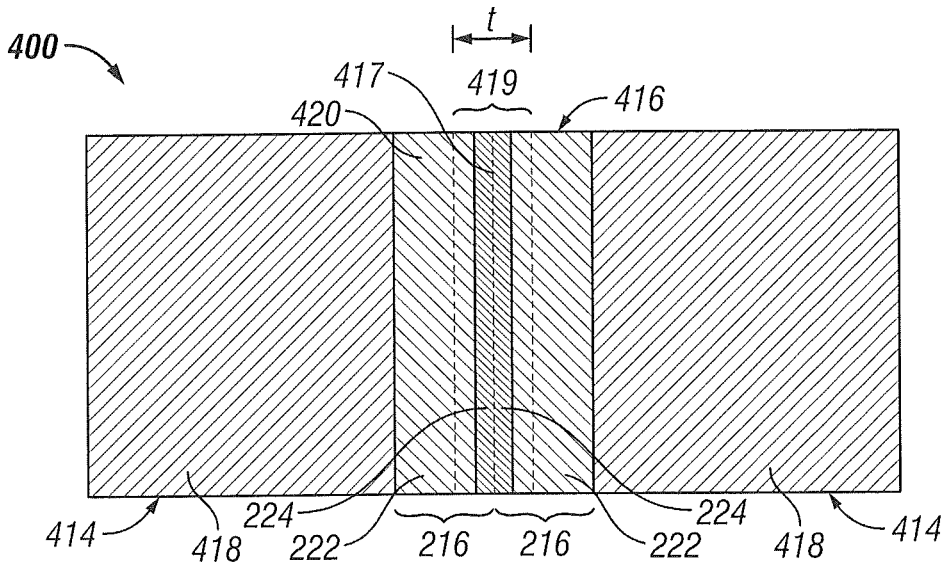
FIG. 6 is a schematic of illustration of another exemplary embodiment of a powder compact made using a powder having multilayer powder particles as it would appear taken along section 6-6 in FIG. 5.

As illustrated in FIG. 6, in another exemplary embodiment, powder compact 400 is formed from powder particles 212 where the coating layer 216 comprises a multilayer coating layer 216 having a plurality of coating layers, and the resulting nanomatrix 416 between adjacent ones of the plurality of dispersed particles 414 comprises the plurality of layers (t) comprising the coating layer 216 of one particle 212, a bond layer 419, and the plurality of layers comprising the coating layer 216 of another one of powder particles 212. In FIG. 6, this is illustrated with a two-layer metallic coating layer 216, but it will be understood that the plurality of layers of multilayer metallic coating layer 216 may include any desired number of layers. The thickness (t) of the bond layer 419 is again determined by the extent of the interdiffusion between the plurality of layers of the respective coating layers 216, and may encompass the entire thickness of nanomatrix 416 or only a portion thereof. In this embodiment, the plurality of layers comprising each coating layer 216 may be used to control interdiffusion and formation of bond layer 419 and thickness (t).

Sintered and forged powder compacts 400 that include dispersed particles 414 comprising Mg and nanomatrix 416 comprising various nanomatrix materials as described herein have demonstrated an excellent combination of mechanical strength and low density that exemplify the lightweight, high-strength materials disclosed herein. Examples of powder compacts 400 that have pure Mg dispersed particles 414 and various nanomatrices 416 formed from powders 210 having pure Mg particle cores 214 and various single and multilayer metallic coating layers 216 that include Al, Ni, W or $Al_2O_3$, or a combination thereof. These powders compacts 400 have been subjected to various mechanical and other testing, including density testing, and their dissolution and mechanical property degradation behavior has also been characterized as disclosed herein. The results indicate that these materials may be configured to provide a wide range of selectable and controllable corrosion or dissolution behavior from very low corrosion rates to extremely high corrosion rates, particularly corrosion rates that are both lower and higher than those of powder compacts that do not incorporate the cellular nanomatrix, such as a compact formed from pure Mg powder through the same compaction and sintering processes in comparison to those that include pure Mg dispersed particles in the various cellular nanomatrices described herein. These powder compacts 200 may also be configured to provide substantially enhanced properties as compared to powder compacts formed from pure Mg particles that do not include the nanoscale coatings described herein. Powder compacts 400 that include dispersed particles 414 comprising Mg and nanomatrix 416 comprising various nanomatrix materials 420 described herein have demonstrated room temperature compressive strengths of at least about 37 ksi, and have further demonstrated room temperature compressive strengths in excess of about 50 ksi, both dry and immersed in a solution of 3% KCl at 200° F. In contrast, powder compacts formed from pure Mg powders have a compressive strength of about 20 ksi or less. Strength of the nanomatrix powder metal compact 400 can be further improved by optimizing powder 210, particularly the weight percentage of the nanoscale metallic coating layers 16 that are used to form cellular nanomatrix 416. Strength of the nanomatrix powder metal compact 400 can be further improved by optimizing powder 210, particularly the weight percentage of the nanoscale metallic coating layers 216 that are used to form cellular nanomatrix 416. For example, varying the weight percentage (wt. %), i.e., thickness, of an alumina coating within a cellular nanomatrix 416 formed from coated powder particles 212 that include a multilayer ($Al/Al_2O_3/Al$) metallic coating layer 216 on pure Mg particle cores 214 provides an increase of 21% as compared to that of 0 wt % alumina.

Powder compacts 400 comprising dispersed particles 414 that include Mg and nanomatrix 416 that includes various nanomatrix materials as described herein have also demonstrated a room temperature sheer strength of at least about 20 ksi. This is in contrast with powder compacts formed from pure Mg powders, which have room temperature sheer strengths of about 8 ksi.

Powder compacts 400 of the types disclosed herein are able to achieve an actual density that is substantially equal to the predetermined theoretical density of a compact material based on the composition of powder 210, including relative amounts of constituents of particle cores 214 and metallic coating layer 216, and are also described herein as being fully-dense powder compacts. Powder compacts 400 comprising dispersed particles that include Mg and nanomatrix 416 that includes various nanomatrix materials as described herein have demonstrated actual densities of about 1.738 $g/cm^3$ to about 2.50 $g/cm^3$, which are substantially equal to the predetermined theoretical densities, differing by at most 4% from the predetermined theoretical densities.

Figure 7:
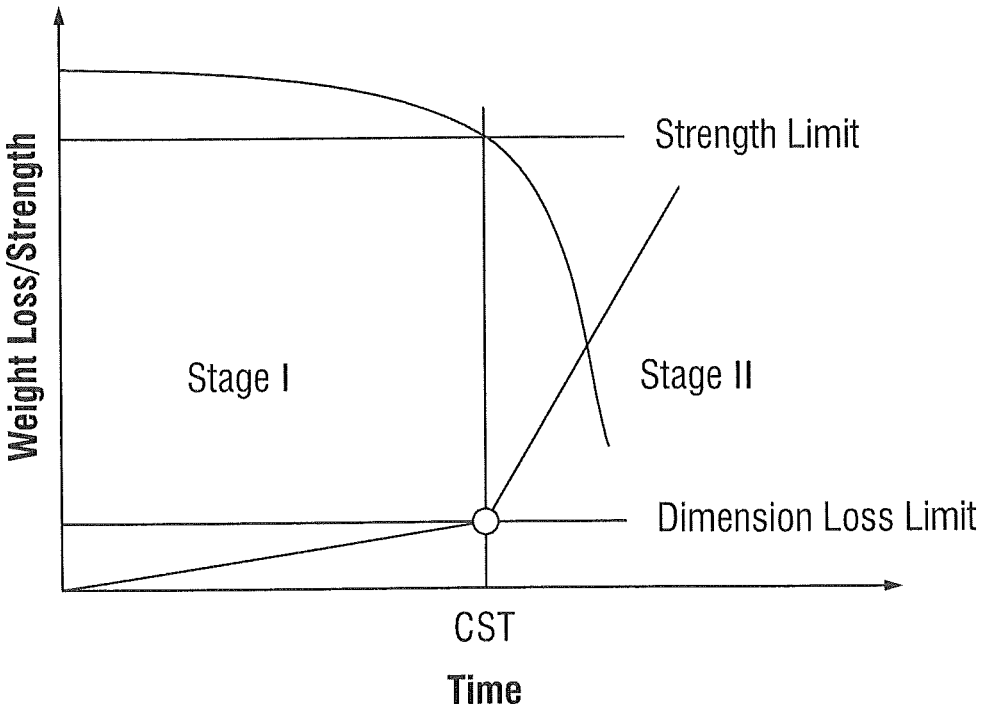
FIG. 7 is a schematic illustration of a change in a property of a powder compact as disclosed herein as a function of time and a change in condition of the powder compact environment.

Powder compacts 400 as disclosed herein may be configured to be selectively and controllably dissolvable in a wellbore fluid in response to a changed condition in a wellbore. Examples of the changed condition that may be exploited to provide selectable and controllable dissolvability include a change in temperature, change in pressure, change in flow rate, change in pH or change in chemical composition of the wellbore fluid, or a combination thereof. An example of a changed condition comprising a change in temperature includes a change in well bore fluid temperature. For example, powder compacts 400 comprising dispersed particles 414 that include Mg and cellular nanomatrix 416 that includes various nanomatrix materials as described herein have relatively low rates of corrosion in a 3% KCl solution at room temperature that range from about 0 to about 11 $mg/cm^2/hr$ as compared to relatively high rates of corrosion at 200° F. that range from about 1 to about 246 $mg/cm^2/hr$ depending on different nanoscale coating layers 216. An example of a changed condition comprising a change in chemical composition includes a change in a chloride ion concentration or pH value, or both, of the wellbore fluid. For example, powder compacts 400 comprising dispersed particles 414 that include Mg and nanomatrix 416 that includes various nanoscale coatings described herein demonstrate corrosion rates in 15% HCl that range from about 4750 $mg/cm^2/hr$ to about 7432 $mg/cm^2/hr$. Thus, selectable and controllable dissolvability in response to a changed condition in the wellbore, namely the change in the wellbore fluid chemical composition from KCl to HCl, may be used to achieve a characteristic response as illustrated graphically in FIG. 7, which illustrates that at a selected predetermined critical service time (CST) a changed condition may be imposed upon powder compact 400 as it is applied in a given application, such as a wellbore environment, that causes a controllable change in a property of powder compact 400 in response to a changed condition in the environment in which it is applied. For example, at a predetermined CST changing a wellbore fluid that is in contact with powder contact 400 from a first fluid (e.g. KCl) that provides a first corrosion rate and an associated weight loss or strength as a function of time to a second wellbore fluid (e.g., HCl) that provides a second corrosion rate and associated weight loss and strength as a function of time, wherein the corrosion rate associated with the first fluid is much less than the corrosion rate associated with the second fluid. This characteristic response to a change in wellbore fluid conditions may be used, for example, to associate the critical service time with a dimension loss limit or a minimum strength needed for a particular application, such that when a wellbore tool or component formed from powder compact 400 as disclosed herein is no longer needed in service in the wellbore (e.g., the CST) the condition in the wellbore (e.g., the chloride ion concentration of the wellbore fluid) may be changed to cause the rapid dissolution of powder compact 400 and its removal from the wellbore. In the example described above, powder compact 400 is selectably dissolvable at a rate that ranges from about 0 to about 7000 $mg/cm^2/hr$. This range of response provides, for example the ability to remove a 3-inch diameter ball formed from this material from a wellbore by altering the wellbore fluid in less than one hour. The selectable and controllable dissolvability behavior described above, coupled with the excellent strength and low density properties described herein, define a new engineered dispersed particle-nanomatrix material that is configured for contact with a fluid and configured to provide a selectable and controllable transition from one of a first strength condition to a second strength condition that is lower than a functional strength threshold, or a first weight loss amount to a second weight loss amount that is greater than a weight loss limit, as a function of time in contact with the fluid. The dispersed particle-nanomatrix composite is characteristic of the powder compacts 400 described herein and includes a cellular nanomatrix 416 of nanomatrix material 420, a plurality of dispersed particles 414 including particle core material 418 that is dispersed within the matrix. Nanomatrix 416 is characterized by a solid-state bond layer 419, which extends throughout the nanomatrix. The time in contact with the fluid described above may include the CST as described above. The CST may include a predetermined time that is desired or required to dissolve a predetermined portion of the powder compact 400 that is in contact with the fluid. The CST may also include a time corresponding to a change in the property of the engineered material or the fluid, or a combination thereof. In the case of a change of property of the engineered material, the change may include a change of a temperature of the engineered material. In the case where there is a change in the property of the fluid, the change may include the change in a fluid temperature, pressure, flow rate, chemical composition or pH or a combination thereof. Both the engineered material and the change in the property of the engineered material or the fluid, or a combination thereof, may be tailored to provide the desired CST response characteristic, including the rate of change of the particular property (e.g., weight loss, loss of strength) both prior to the CST (e.g., Stage 1) and after the CST (e.g., Stage 2), as illustrated in FIG. 7.

Without being limited by theory, powder compacts 400 are formed from coated powder particles 212 that include a particle core 214 and associated core material 218 as well as a metallic coating layer 216 and an associated metallic coating material 220 to form a substantially-continuous, three-dimensional, cellular nanomatrix 216 that includes a nanomatrix material 420 formed by sintering and the associated diffusion bonding of the respective coating layers 216 that includes a plurality of dispersed particles 414 of the particle core materials 418. This unique structure may include metastable combinations of materials that would be very difficult or impossible to form by solidification from a melt having the same relative amounts of the constituent materials. The coating layers and associated coating materials may be selected to provide selectable and controllable dissolution in a predetermined fluid environment, such as a wellbore environment, where the predetermined fluid may be a commonly used wellbore fluid that is either injected into the wellbore or extracted from the wellbore. As will be further understood from the description herein, controlled dissolution of the nanomatrix exposes the dispersed particles of the core materials. The particle core materials may also be selected to also provide selectable and controllable dissolution in the wellbore fluid. Alternately, they may also be selected to provide a particular mechanical property, such as compressive strength or sheer strength, to the powder compact 400, without necessarily providing selectable and controlled dissolution of the core materials themselves, since selectable and controlled dissolution of the nanomatrix material surrounding these particles will necessarily release them so that they are carried away by the wellbore fluid. The microstructural morphology of the substantially-continuous, cellular nanomatrix 416, which may be selected to provide a strengthening phase material, with dispersed particles 414, which may be selected to provide equiaxed dispersed particles 414, provides these powder compacts with enhanced mechanical properties, including compressive strength and sheer strength, since the resulting morphology of the nanomatrix/dispersed particles can be manipulated to provide strengthening through the processes that are akin to traditional strengthening mechanisms, such as grain size reduction, solution hardening through the use of impurity atoms, precipitation or age hardening and strength/work hardening mechanisms. The nanomatrix/dispersed particle structure tends to limit dislocation movement by virtue of the numerous particle nanomatrix interfaces, as well as interfaces between discrete layers within the nanomatrix material as described herein. This is exemplified in the fracture behavior of these materials. A powder compact 400 made using uncoated pure Mg powder and subjected to a shear stress sufficient to induce failure demonstrated intergranular fracture. In contrast, a powder compact 400 made using powder particles 212 having pure Mg powder particle cores 214 to form dispersed particles 414 and metallic coating layers 216 that includes Al to form nanomatrix 416 and subjected to a shear stress sufficient to induce failure demonstrated transgranular fracture and a substantially higher fracture stress as described herein. Because these materials have high-strength characteristics, the core material and coating material may be selected to utilize low density materials or other low density materials, such as low-density metals, ceramics, glasses or carbon, that otherwise would not provide the necessary strength characteristics for use in the desired applications, including wellbore tools and components.

The plugs 16 enable the housing 12 of the arrangement 10 to hold an amount of fluid pressure that is related to an operation for which the arrangement was manufactured. In one embodiment, the plug(s) 16 are configured to hold a high pressure associated with a setting operation of a packer 22.

In use, and for purposes of illustration, using an exemplary sequence of events including a packer setting operation; a frac operation; and production, the arrangement disclosed herein is run in the hole. While prior art arrangements would be run with the valve 18 in a closed position, the present arrangement is run with one or more valves 18 in an open position. Because the plug(s) 16 prevent fluid movement through the one or more openings 14, operations utilizing pressure for setting such as the noted packer setting operation can be undertaken with the arrangement 10 already in an open position. This translates to the elimination of a run to shift the valve 18 to an open position after the packer setting operation is completed, which would otherwise have been needed in the prior art. The second noted operation in the example is a frac operation. For such operation the one or more openings 14 must be patent and the valve 18 must be in a position that allows fluid pressure to communicate between the tubing and the annulus so that tubing pressure is communicated to the formation to fracture the same. Since in the exemplary scenario introduced, the valve(s) 18 is already open, no mechanical intervention is necessary. Rather, all that is necessary is the reduction of the plug(s) 16. In each case of the materials contemplated, whether time of exposure to wellbore fluids or the specific application of a reagent, such as an acid, is the progenitor of the reduction and or dissolution of the plug(s) 16, the ultimate result is that the plug(s) 16 will cease to be an impediment to tubing pressure reaching the formation. In this manner the frac operation is facilitated and did not require a separate mechanical intervention run. Subsequent to the frac operation in the exemplary embodiment, production through the tubing is expected. Clearly production through the tubing string is not supported if an opening is left in the housing 12. To remedy this situation a mechanical intervention run will be undertaken and the valve 18 closed. While the described embodiment does utilize a separate run, it uses only one separate run, not the two separate runs of the prior art were that art used to achieve the objectives of the exemplary scenario.

As one of skill in the art will be aware, a single run can cost hundreds of thousands of dollars. The elimination of a run therefore is a substantial benefit to the art.

The arrangement is employed in a method for carrying out a series of downhole operations with a reduced number of mechanical intervention runs by running the arrangement to target depth and carrying out a downhole operation such as pressuring up on the tubing string to effect setting of a packer; one or more of exposing at least the plug(s) 16 to downhole fluids (natural or introduced) and migrating a dissolving fluid (such as but not limited to an acid) to at least the plug(s) 16 to reduce or eliminate the plug(s) 16; pressuring up on the tubing string to effect another operation downhole that involves the annulus of the tubing string; running a mechanical intervention tool to the target depth and closing the one or more valves 18 thereby preparing the tubing string to another operation not involving communication of tubing pressure to the annulus.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A flow control arrangement comprising:

a housing defining one or more openings therein;

a valve structure alignable and misalignable with the one or more openings in the housing; and one or more plugs, one plug in at least one of the one or more openings, each plug being dissolvable by exposure to one or more of downhole fluids and applied dissolution fluids, wherein the one or more plugs includes a substantially-continuous, cellular nanomatrix comprising a nanomatrix material, a plurality of dispersed particles comprising a particle core material that comprises Mg, Al, Zn or Mn, or a combination thereof, dispersed in the cellular nanomatrix, and a solid state bond layer extending throughout the cellular nanomatrix between the dispersed particles.

2. A flow control arrangement as claimed in claim 1 wherein the valve structure is a sliding sleeve.

3. A flow control arrangement as claimed in claim 1 wherein the valve structure includes one or more ports.

4. A flow control arrangement as claimed in claim 1 wherein one or more plugs comprise a material reducible upon exposure to natural downhole fluids.

5. A flow control arrangement as claimed in claim 1 wherein one or more plugs comprise a material reducible upon exposure to introduced downhole fluids.

6. A flow control arrangement as claimed in claim 5 wherein the introduced downhole fluids include acid.

7. A method for carrying out a series of downhole operations with a reduced number of mechanical intervention runs comprising:

running the arrangement of claim 1 to a target depth;

carrying out a first downhole operation requiring fluid permeability of the housing be restricted radially;

dissolving the plug;

carrying out a second downhole operation requiring fluid pressure communication through the one or more openings; and mechanically intervening to close the valve structure thereby rendering the one or more openings of the arrangement radially impermeable.

8. A method as claimed in claim 7 wherein the carrying out a first downhole operation with the housing radially fluid restricted is setting a packer.

9. A method as claimed in claim 7 wherein the carrying out a second downhole operation requiring fluid pressure communication through the one or more openings is fracing.

10. A method as claimed in claim 7 wherein the valve structure is a sliding sleeve, and wherein the mechanical intervening is shifting the sliding sleeve.

* * * * *